US006230803B1

(12) United States Patent
Morton et al.

(10) Patent No.: US 6,230,803 B1
(45) Date of Patent: May 15, 2001

(54) APPARATUS AND METHOD FOR TREATING AND GRAVEL-PACKING CLOSELY SPACED ZONES

(75) Inventors: Robert D. Morton; Christian F. Bayne; Perry Douglas Baycroft, all of Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/454,668

(22) Filed: Dec. 3, 1999

Related U.S. Application Data

(60) Provisional application No. 60/110,763, filed on Dec. 3, 1998.

(51) Int. Cl.[7] ..... E21B 43/04
(52) U.S. Cl. ..... 166/278; 166/51
(58) Field of Search ..... 166/51, 270, 313, 166/227, 233, 236, 332.1

(56) References Cited

U.S. PATENT DOCUMENTS

| | | | | |
|---|---|---|---|---|
| 3,865,188 | | 2/1975 | Doggett et al. . | |
| 4,270,608 | | 6/1981 | Hendrickson et al. . | |
| 4,635,725 | | 1/1987 | Burroughs | 166/278 |
| 4,945,991 | | 8/1990 | Jones . | |
| 4,995,456 | * | 2/1991 | Cornette et al. | 166/51 |
| 5,082,052 | | 1/1992 | Jones et al. . | |
| 5,083,614 | * | 1/1992 | Branch | 166/278 |
| 5,113,935 | | 5/1992 | Jones et al. . | |
| 5,145,004 | | 9/1992 | Cornette . | |
| 5,341,880 | | 8/1994 | Thorstensen et al. . | |
| 5,411,090 | * | 5/1995 | Cornette et al. | 166/278 |
| 5,417,284 | | 5/1995 | Jones . | |
| 5,419,394 | | 5/1995 | Jones . | |
| 5,476,143 | | 12/1995 | Sparlin et al. . | |
| 5,515,915 | | 5/1996 | Jones et al. . | |
| 5,577,559 | * | 11/1996 | Voll et al. | 166/278 |
| 5,690,175 | | 11/1997 | Jones | 166/278 |
| 5,845,712 | * | 12/1998 | Griffith et al. | 166/278 |
| 5,921,318 | | 7/1999 | Ross | 166/250 |

FOREIGN PATENT DOCUMENTS

| | | |
|---|---|---|
| 0 414 431 A2 | 2/1991 | (EP) . |
| 2317630A | 4/1998 | (GB) . |

* cited by examiner

*Primary Examiner*—Frank Tsay
(74) *Attorney, Agent, or Firm*—Duane, Morris & Heckscher LLP

(57) ABSTRACT

A completion assembly facilitates gravel-packing and fracturestimulation of closely spaced zones. The assembly includes a pair of spaced screens with a production packer in between. The production packer has a short bypass flowpath therethrough to allow fluids carrying the gravel to pass the production packer so that the upper and lower zones can be gravel-packed simultaneously, as well as fracture-stimulated simultaneously. Thereafter, the presence of the gravel in the bypass tube in the packer between the zones provides some limited isolation based on the permeability of the gravel found in the bypass passage and the pressure drop across that passage. Production then can follow from the lower zone, the upper zone, or both zones depending on the completion configuration.

19 Claims, 2 Drawing Sheets

APPARATUS AND METHOD FOR TREATING AND GRAVEL-PACKING CLOSELY SPACED ZONES

This application claims benefit to U.S. provisional application Ser. No. 60/110,763 filed Dec. 3, 1998.

FIELD OF THE INVENTION

The field of this invention relates to techniques and equipment to gravel-pack and treat closely spaced zones and more particularly in applications where some degree of isolation is desired between the zones for production.

BACKGROUND OF THE INVENTION

In producing hydrocarbons or the like from loosely or unconsolidated and/or fractured formations, it is not uncommon to produce large volumes of particulate material along with the formation fluids. As is well-known in the art, these particulates routinely cause a variety of problems and must be controlled in order for production to be economical. Probably, the most popular technique used for controlling the production of particulates (e.g., sand) from a well is one which is commonly known as "gravel-packing."

In a typical gravel-packed completion, a screen is lowered into the wellbore on a work string and is positioned adjacent to the subterranean formation to be completed, e.g., a production formation. Particulate material, collectively referred to as "gravel," and a carrier fluid is then pumped as a slurry down the work string where it exits through a "cross-over" into the well annulus formed between the screen and the well casing or open hole, as the case may be. The carder liquid in the slurry normally flows into the formation and/or through the screen itself, which, in turn, is sized to prevent flow of gravel therethrough. This results in the gravel being deposited or "screened out" in the well annulus where it collects to form a gravel pack around the screen. The gravel, in turn, is sized so that it forms a permeable mass which allows the flow of the produced fluids therethrough and into the screen while blocking the flow of the particulates produced with the production fluids.

One major problem that occurs in gravel-packing single zones, particularly where they are long or inclined, arises from the difficulty in distributing the gravel over the entire completion interval, i.e., completely packing the entire length of the well annulus around the screen. This poor distribution of gravel (i.e., incomplete packing of the interval) is often caused by the carrier fluid in the gravel slurry being lost into the more permeable portions of the formation which, in turn, causes the gravel to form "sand bridges" in the annulus before all the gravel has been placed. Such bridges block further flow of slurry through the annulus which prevents the placement of sufficient gravel (a) below the bridge in top-to-bottom packing operations or (b) above the bridge in bottom-to-top packing operations.

To address this specific problem, "alternate path" well strings have been developed which provide for distribution of gravel throughout the entire completion interval, even if sand bridges form before all the gravel has been placed. Some examples of such screens include U.S. Pat. Nos. 4,945,991; 5,082,052; 5,113,935; 5,417,284; 5,419,394; 5,476,143; 5,341,880; and 5,515,915. In these well screens, the alternate paths (e.g., perforated shunts or bypass conduits) extend along the length of the screen and are in fluid communication with the gravel slurry as the slurry enters the well annulus around the screen. If a sand bridge forms in the annulus, the slurry is still free to flow through the conduits and out into the annulus through the perforations in the conduits to complete the filling of the annulus above and/or below the sand bridge.

One of the problems with the alternate path design is the relatively small size of the passages through them. These tubes are also subject to being crimped or otherwise damaged during the installation of the screen. Thus, several designs in the past have placed these tubes inside the outer surface of the screen. This type of design substantially increases the cost of the screen over commercially available screens. Yet other designs have recognized that it is more economical to place such tubes on the outsides of the screen and have attempted to put yet another shroud over the alternate paths which are on the outside of the screen to prevent them from being damaged during insertion or removal. Such a design is revealed in U.K application No. GB 2317 630 A.

While such designs can be of some benefit in a bridging situation, they present difficulties in attempting to treat and gravel-pack zones which are fairly close together. Many times zones are so close together that traditional isolation devices between the zones cannot be practically employed because the spacing is too short. For example, situations occur where an upper and lower zone are spaced only 5–20 feet from each other, thus precluding a complete completion assembly in between screens for each of the zones. When these closely spaced zones are encountered, it is desirable to be able to gravel-pack and treat the formations at the same time so as to save rig time by eliminating numerous trips into the well. At times these types of completions will also require some degree of isolation between them, while at the same time producing one or the other of the formations. Accordingly, the objective of the apparatus and method of the present invention is to facilitate fluid treatments such as fracture stimulation, as well as gravel-packing, simultaneously, in two or more adjacent producing zones. Another object of the method and apparatus of the present invention is to provide limited hydraulic isolation between two or more adjacent zones. Yet another object of the present invention is to minimize rig time for the completion by reducing the number of trips required to install the gravel screen assemblies and to treat the formation. These objectives and how they are accomplished will become more clear to those skilled in the art from a review of the detailed description of the preferred embodiment below.

SUMMARY OF THE INVENTION

A completion assembly facilitates gravel-packing and fracturestimulation of closely spaced zones. The assembly includes a pair of spaced screens with a production packer in between. The production packer has a short bypass flowpath therethrough to allow fluids carrying the gravel to pass the production packer so that the upper and lower zones can be gravel-packed simultaneously, as well as fracture-stimulated simultaneously. Thereafter, the presence of the gravel in the bypass tube in the packer between the zones provides some limited isolation based on the permeability of the gravel found in the bypass passage and the pressure drop across that passage. Production then can follow from the lower zone, the upper zone, or both zones depending on the completion configuration.

DETAILED DESCRIPTION OF THE PREFERRED EMBODIMENT

Figure 1:
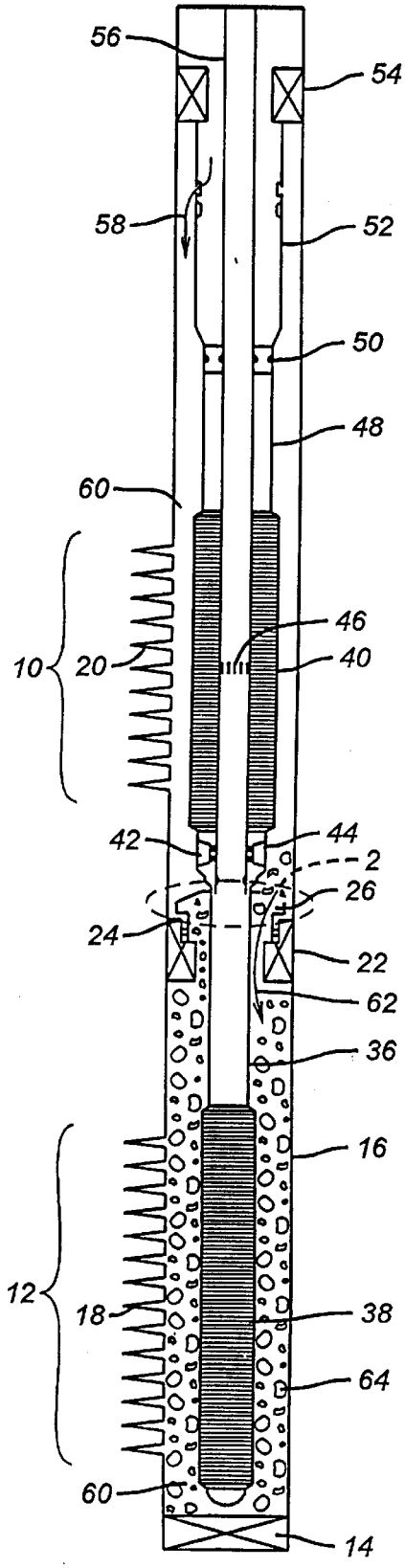
FIG. 1 illustrates the assembly as installed, ready to gravel-pack and fracture-stimulate.
Figure 2:
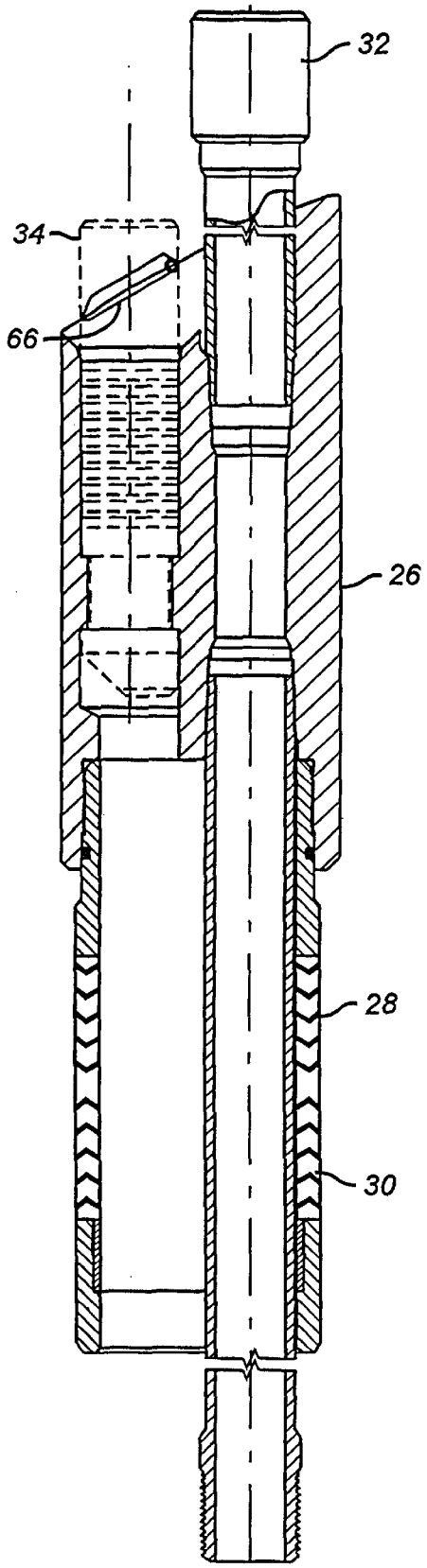
FIG. 2 is a detail of one of the components in the assembly of FIG. 2, shown by - circle 2, illustrating the communication through the production packer to facilitate gravel-packing and fracture-stimulation of two zones simultaneously.

Referring to FIG. 1, two closely spaced formations 10 and 12 are illustrated. The formations 10 and 12 are closely spaced in the order of 5–20 ft. FIG. 1 illustrates that the bridge plug 14 has been set in the casing 16. The casing 16 has been perforated as indicated by perforations 18 and 20 which are, respectively, in zones 12 and 10. Subsequent to perforation, should it be necessary, a cleanout trip can be made to clean the wellbore before installing the assembly illustrated in FIG. 1. Thereafter, the production packer 22 is run-in to the desired depth and set. In the preferred embodiment, a Baker Oil Tools-type FA-1 packer is used. The packer 22 has a seal bore 24. Inserted into seal bore 24 is a parallel flow tube 26 shown in more detail in FIG. 2. The preferred embodiment includes the use of a Model A, fully opening parallel flow tube made by Baker Oil Tools. FIG. 2 indicates that the flow tube 26 has opposed chevron seals 28 and 30 which contact the seal bore 24 of the production packer 22. A main flow tube 32 extends parallel to a bypass tube 34. Referring to FIG. 1, the main flow tube 32 is connected at its lower end to a section of blank pipe 36, which in turn supports the lower screen 38. Although any type of gravel-pack screen can be used, in the preferred embodiment a Baker Weld 140 Screen made by Baker Hughes Inteq can be used. An upper screen 40 is preferably made of the same construction as the lower screen 38 and is disposed adjacent the perforations 20. Screen 38 is disposed adjacent perforations 18. Mounted below the screen 40 is a seal bore receptacle 42. Screen 40 has a locator seal assembly 44 which engages the seal bore receptacle 42. Above screen 40 is a blank pipe 48, and on top of that is a shear-out safety joint 50. Connected to the shear-out safety joint 50 is a gravel-pack cross-over 52, preferably a Model CK made by Baker Oil Tools. Attached to the cross-over 52 is a gravel-pack packer 54.

The assembly is run in the hole to the position shown in FIG. 1 and the packer 54 is set and tested. This is done using the Standard Crossover Tool/Service Tool configuration. Thereafter, surface pumps are turned on to pump fracture-stimulation or gravel-pack treatment through the production tubing. The path of fluid flow is through the cross-over 52, as indicated by arrow 58. The fluid laden with gravel passes along the annular space 60, past screen 40, and through bypass tube 34 in parallel flow tube 26 (see FIG. 2), as indicated by arrow 62 (see FIG. 1). Flow then arrives at screen 38 to deposit gravel 64 the length of the annular space 60 down to screen 38.

Referring to FIG. 2, the bypass tube 34 can have a spring-biased flapper 66 which opens upon higher pressures uphole against the bias of a torsion spring in a manner well-known in the art.

Depending on the formation properties, gravel-packing and fracturing can occur in separate but closely spaced zones using the assembly shown in FIG. 1. Depending upon which zone is more prone to fracturing, the pressures and flow rates are incrementally increased so that ultimately both zones 10 and 12 are properly fractured or treated. The use of the short bypass tube 34 ensures that the pressure drop across the parallel flow tube 26 is minimal. This allows the achievement of sufficiently high flow rates into zone 12 to properly fracture it. Those skilled in the art can appreciate that wash pipes can be used internally to the screens 40 and 38, and carrier fluid type and travel concentration can be selected, to facilitate the proper deposition of the gravel 64, particularly around screen 38. Any return fluids to the surface come up internally through the screens 38 and 40 and back through the cross-over 52 in a manner well-known in the art.

When both screens 38 and 40 are properly gravel-packed with gravel 64 and the formations 10 and 12 have been properly fractured, a production string 56 is run-in from the surface and internally to the screen 40, which also includes a sliding sleeve valve 46, preferably of the CM-type made by Baker Oil Tools. Production from either or both zones can begin. The lower zone 12 can be produced by keeping the sliding sleeve valve 46 in a closed position. It should be noted that at the conclusion of the gravel-packing, the entire annulus 60 is full, including the bypass tube 34. Thus, the presence of gravel throughout tends to reduce migration from formation 10 down to formation 12 when formation 12 is being produced. The permeability of the gravel pack and, to some extent, the presence of the flapper 66, if used, act to retard migration between the two formations in annulus 60. When it is no longer desired to produce zone 12 and zone 10 is to be produced, a plug can be run down to the seal bore receptacle 42 to isolate zone 12 so that zone 10 can be produced after the sliding sleeve valve 46 is opened. Other techniques may be used for producing either zone 10 or 12 which are known to those skilled in the art.

The completion assembly thus illustrated in FIGS. 1 and 2 provides minimal resistance to flow between two closely spaced zones so as to allow the appropriate flows and pressures to properly fracture two zones simultaneously while gravel-packing them. It could also be used for other downhole treatments of closely spaced formations, such as acidizing, as one example. This technique should be contrasted with attempting to accomplish the same task using screens with alternative flow tubes that extend the entire length of the screen. Such tubes, which are perforated, create sufficient pressure drops so as to preclude effective fracturing below the initial screen. Accordingly, a technique which provides communication between closely spaced zones but at the price of very large pressure drops precludes the ability to effectively gravel-pack and treat or fracture adjacent formations with any degree of reliability. On the other hand, the apparatus and method as disclosed is not limited by very long tubes extending the lengths of the screens. Instead, a very short bypass tube 34 located in the production packer 22 is the sole significant resistance to flow between the zones for the purposes of treatment or fracturing. Those skilled in the art will appreciate that a flapper 66 is pushed out of the flowpath so as to provide minimal resistance to flow in the fully open position. Additionally, some level of isolation between the zones 10 and 12 is achieved as the annulus 60, including the area between screens 40 and 38, is packed with gravel 64. While the isolation is not perfect, it is the best that can be obtained under the circumstances while attempting to achieve the objective of gravel-packing screens in adjacent zones while treating or fracturing at the same time.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for completion of adjacent zones in a well bore at the same time comprising:

at least two screens each having an interior and an exterior, said exterior defining an annular space in the well bore;

a first packer disposed between said screens having a bore;

a connector sealingly insertable into said bore in said first packer having a first path which is connected to said interiors of both screens and a second path through said first packer and communicating the annular spaces defined by the exteriors of said screens.

2. The apparatus of claim 1, wherein said second path further comprises a valve.

3. The apparatus of claim 1, wherein;

said second path is not substantially longer than said first packer.

4. The apparatus of claim 1, wherein:

said second path accumulates slurry pumped therethrough which provides resistance to flow therethrough when production from at least one of said zones commences.

5. The apparatus of claim 1, further comprising:

a second packer connected to a cross over which is in turn connected to one of said screens whereupon flow through said crossover and said second path communicates with both zones from said annular space.

6. The apparatus of claim 3, further comprising:

a wash pipe insertable into the interior of said screens further comprising valving to allow production through said wash pipe from one or more zones through one or more of said screens at the same time.

7. The apparatus of claim 2, wherein:

said second path is not substantially longer than said first packer.

8. The apparatus of claim 7, wherein:

said second path accumulates slurry pumped therethrough which provides resistance to flow therethrough when production from at least one of said zones commences.

9. The apparatus of claim 8, further providing:

a second packer connected to a cross over which is in turn connected to one of said screens whereupon flow through said crossover and said second path communicates with both zones from said annular space.

10. The apparatus of claim 9, further comprising:

a wash pipe insertable into the interior of said screens further comprising valving to allow production through said wash pipe from one or more zones through one or more of said screens at the same time.

11. A method of completing adjacent zones at the same time comprising:

running in a packer between two screens;

providing at least two paths through said packer;

using one of said paths to communicate annular spaces outside said screens for delivery of completion fluid or gravel.

12. The method of claim 11, further comprising:

using another of said paths to connect the interiors of said screens.

13. The method of claim 12, further comprising;

depositing gravel in an annular space outside said screens and in said path connecting them in said packer.

14. The method of claim 13, further comprising:

using said gravel to resist flow in said annular space through said packer.

15. The method of claim 11, further comprising:

providing a valve in said path that communicates annular spaces outside said screens.

16. The method of claim 15, further comprising:

providing a one way valve in said path that communicates annular spaces outside said screens.

17. The method of claim 14, further comprising:

providing a valve in said path that communicates annular spaces outside said screens.

18. The method of claim 17, further comprising:

providing a one way valve in said path that communicates annular spaces outside said screens.

19. The method of claim 18, further comprising:

running a second packer and a crossover above said screens;

inserting a wash pipe in said screens;

producing through one or more of said screens at a time, through said wash pipe.

* * * * *